US005832670A

United States Patent [19]

Bennett

[11] Patent Number: 5,832,670

[45] Date of Patent: Nov. 10, 1998

[54] PRE-HUNG DOOR KIT WITH SELECTIVELY REVERSIBLE HAND

[76] Inventor: Laurence E. Bennett, 77 Seventh Ave., New York, N.Y. 10011

[21] Appl. No.: 891,389

[22] Filed: Jul. 11, 1997

[51] Int. Cl.[6] ..... E05D 7/02

[52] U.S. Cl. ..... 49/382; 49/193; 49/504; 52/210

[58] Field of Search ..... 49/382, 504, 193; 52/215, 210, 656.4

[56] References Cited

U.S. PATENT DOCUMENTS

| | | | |
|---|---|---|---|
| 2,639,472 | 5/1953 | Jösson . | |
| 2,736,930 | 6/1956 | Longley . | |
| 3,331,162 | 7/1967 | Draper | 49/504 |
| 3,769,773 | 11/1973 | Mochizuki . | |
| 3,808,759 | 5/1974 | Carmichael . | |
| 4,467,576 | 8/1984 | Bürgers . | |
| 4,642,954 | 2/1987 | Sigerist . | |
| 5,095,671 | 3/1992 | Mitani | 52/210 |
| 5,365,708 | 11/1994 | Winston . | |

FOREIGN PATENT DOCUMENTS

| | | | |
|---|---|---|---|
| 128696 | 8/1948 | Australia | 52/215 |

*Primary Examiner*—Jerry Redman
*Attorney, Agent, or Firm*—Arthur Jacob

[57] ABSTRACT

A pre-hung door assembly kit enables the selective reversal of the hand of a pre-hung door mounted with hinges in a door frame for opening in one of right-hand and left-hand openings. The reversal is accomplished by rotating the door about a vertical axis and relocating vertical door jamb legs to maintain the correct juxtaposition of a previously prepared latching hardware location in the door with an appropriate previously prepared strike plate mortise in one of the door jamb legs so that factory precision is maintained with simplified field installation. Door stops are placed on the jamb legs so as to cover fasteners which secure the door frame in place in a building wall.

15 Claims, 6 Drawing Sheets

PRE-HUNG DOOR KIT WITH SELECTIVELY REVERSIBLE HAND

BACKGROUND OF THE INVENTION

The present invention relates generally to building construction and pertains, more specifically, to the hanging of doors in the construction of buildings.

Increases in the volume of building construction, including improvements to existing buildings as well as new construction, have led to a demand for more simplified and more economical building materials, components and techniques. One particular segment of the increased volume which has exhibited widespread growth is the field of home improvement where a great deal of the work is accomplished by amateur carpenters and builders seeking easier and more foolproof procedures at reduced cost. In response to the demand, the building supply industry has offered various modular kits and assemblies in which a good deal of the operations which require more skill and specialized tools are completed in the factory, leaving only less complex procedures for the installer in the field.

Among the more successful modules offered for building construction is the pre-hung door assembly in which a door is fully prepared for the reception of latching hardware and is hinged in a door frame so that all the installer need do is mount the door frame within a prepared building wall in order to achieve a properly hung door. The precision with which the door is located and hung within the frame and the accuracy with which the door is prepared for the reception of latching hardware is maintained at a high level by virtue of accomplishing those operations in the factory, with specialized manufacturing tooling, leaving little to chance and to the less sophisticated tools and procedures available to installers in the field.

In order to accommodate the requirement for both right-hand and left-hand openings, it has been necessary to supply pre-hung door assemblies in both configurations, enabling an installer to select the appropriate assembly for a particular installation. The necessity to make available pre-hung door assemblies in both hands essentially doubles the number of assemblies which must be made available by the manufacturer and by the distributor and retailer, requiring larger inventories and the concomitant dedication of greater amounts of space, both for storage and on the selling floor. It has been suggested that pre-hung door assemblies be constructed with selectively reversible hands; however, such reversible assemblies have been limited to those in which the door designs, such as flat, or flush doors, permit inversion of the door to attain reversal of the hand. Other door designs such as, for example, traditional panelled doors, heretofore have not been amenable to incorporation within selectively reversible hand pre-hung door assemblies.

SUMMARY OF THE INVENTION

The present invention provides a pre-hung door assembly kit which allows selective reversal of the hand of the door, regardless of the design of the door, thereby enabling the manufacturer and vendors to maintain a reduced inventory while preserving the attributes of the pre-hung door assembly. As such, the present invention attains several objects and advantages, some of which are summarized as follows: Provides a pre-hung door assembly kit in which the hand is selectively reversible with ease and accuracy; makes available the selective reversal of the hand of a pre-hung door regardless of the design of the door, while preserving the aesthetic appearance as well as the accuracy of the assembly; attains ease of reversal of a pre-hung door without the necessity for exceptional skill and specialized tools, while maintaining a high degree of precision and integrity in the completed assembly; enables the reduction of inventories at both the manufacturing facility and the sales outlets for increased efficiency and better economy; makes available a more compact pre-hung door assembly kit, requiring less storage space and less space on the selling floor; offers pre-hung door assemblies having a wider variety of door designs for greater aesthetic appeal; enables an aesthetically more pleasing appearance in the completed installation with reduced installation effort; provides rugged pre-hung door assemblies of uniform high quality for exemplary performance over a long service life.

The above objects and advantages, as well as further objects and advantages, are attained by the present invention, which may be described briefly as providing, in a pre-hung door assembly kit which enables the selective reversal of the hand of a pre-hung door mounted with hinges in a door frame for opening in one of right-hand and left-hand openings, the door having opposite first and second faces, an upper edge, a lower edge, laterally opposite first and second side edges extending longitudinally between the upper and lower edges, a longitudinal axis extending along the door intermediate the first and second side edges of the door, a transverse thickness between the opposite first and second faces, and a latch location adjacent the first side edge and spaced a predetermined distance from the lower edge, the door frame having a top and laterally opposite first and second sides, the kit comprising an improvement wherein: the hinges each include a longitudinal hinge pin socket for location adjacent one of the first and second faces of the door, and a hinge plate extending transversely from the hinge pin socket a transverse distance to an opposite hinge plate edge; the door frame includes first and second door jamb legs, the first door jamb leg having opposite first and second surfaces, a first end and a longitudinally opposite second end, the opposite first and second surfaces being located such that one of the first and second surfaces confronts the first side edge of the door; the first surface of the first door jamb leg includes a first strike plate mortise spaced from one of the first and second ends a distance corresponding to the predetermined distance between the lower edge of the door and the latch location; the second surface of the first door jamb leg includes a second strike plate mortise spaced from one of the first and second ends a distance corresponding to the predetermined distance between the lower edge of the door and the latch location; and the second door jamb leg has longitudinally opposite first and second ends and the hinges are mounted between the second door jamb leg and the second side edge of the door to hang the door in the door frame for opening in one of the right-hand and left-hand openings; whereupon by placement of the first door jamb leg along the first side of the door frame, with the first surface confronting the first side edge of the door, the first strike plate mortise confronts the latch location, and by mounting the hinges in a first position between the second side edge of the door and the second door jamb leg, with the hinge pin sockets adjacent the first face of the door, the door is hung to open in one of the right-hand and left-hand openings; and whereupon by reversal of the hinges to mount the hinges in a second position between the second side edge of the door and the second door jamb leg, with the hinge pin sockets adjacent the second face of the door, rotation of the door about the longitudinal axis thereof, and placement of the first door jamb leg along the second side of the door frame, with the second surface of the first door jamb confronting the first side edge of the door, the second strike plate mortise confronts the latch location and the door is hung to open in the other of the right-hand and left-hand openings.

Further, the present invention provides an improvement in a pre-hung door assembly kit in which a door is mounted in a door frame for movement between open and closed positions and is seated against door stops secured to door jamb legs of the door frame, the improvement comprising: door stop areas extending along the door jamb legs; door stop locating elements for selectively locating the door stops on the door jamb legs along the door stop areas; and fastener areas within the door stop areas of the door jamb legs, the fastener areas being located such that the fastener areas are covered by the door stops when the door stops are in place on the door jamb legs.

DESCRIPTION OF THE DRAWINGS

The invention will be understood more fully, while still further objects and advantages will become apparent, in the following detailed description of a preferred embodiment of the invention illustrated in the accompanying drawing, in which.

DETAILED DESCRIPTION OF THE DRAWINGS

Figure 2:
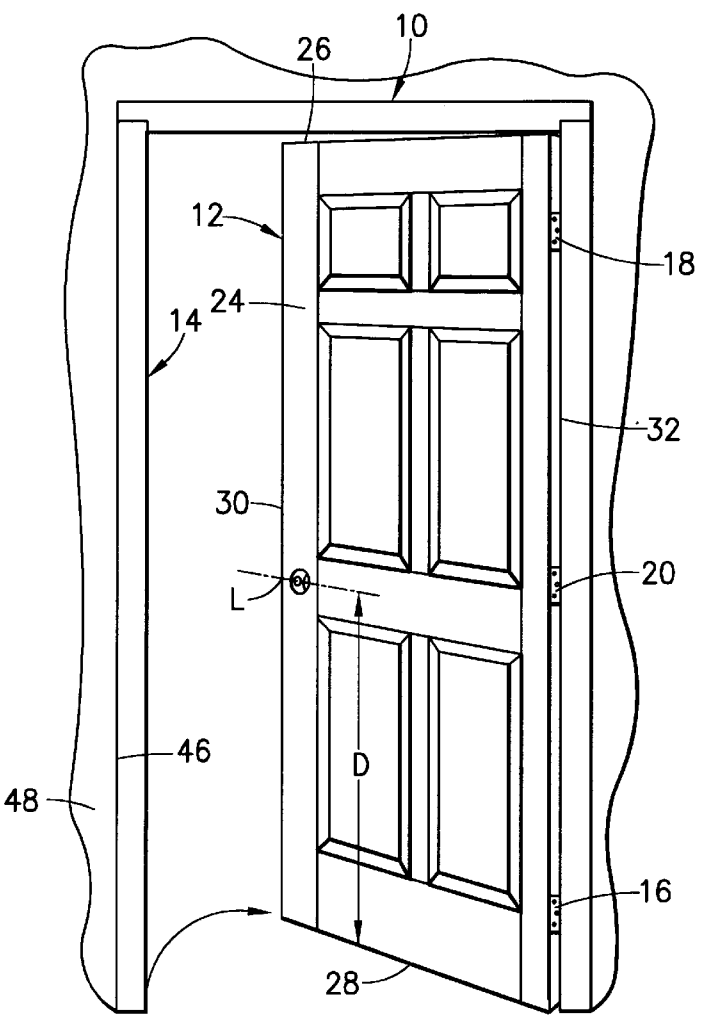
FIG. 2 is a pictorial view showing the pre-hung door assembly re-configured for a right-hand opening.
Figure 1:
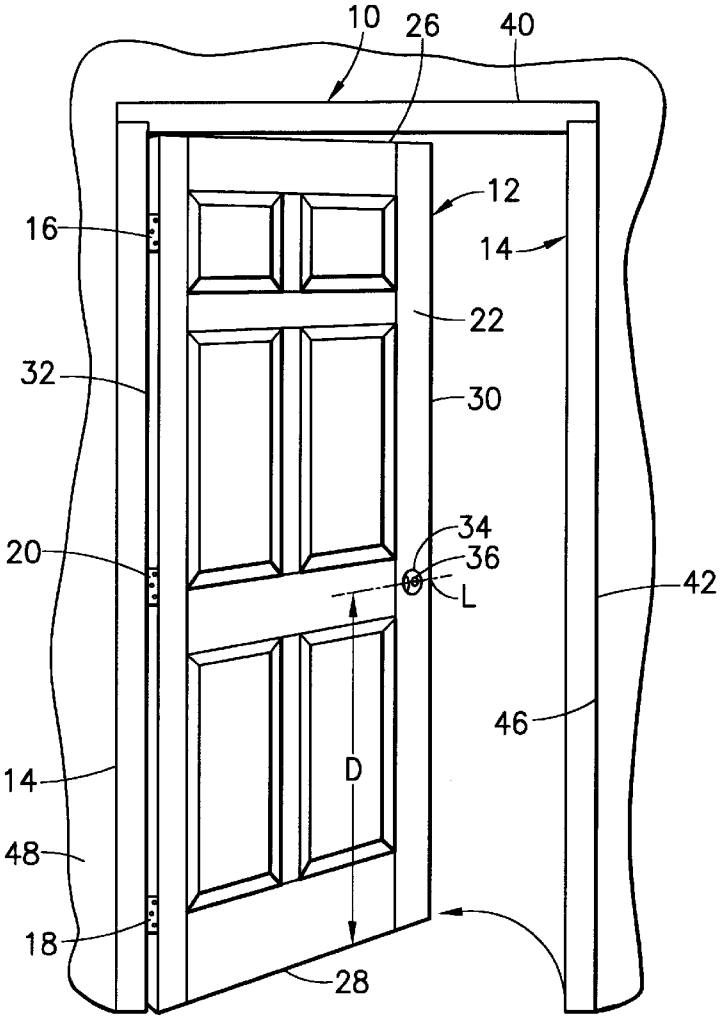
FIG. 1 is a pictorial view showing a pre-hung door assembly constructed in accordance with the present invention and configured for a left-hand opening.

Referring now to the drawing, and especially to FIGS. 1 and 2 thereof, a pre-hung door assembly 10 is seen to include a door 12 mounted in a door frame 14 by means of hinges 16, 18 and 20 located between the door 12 and the door frame 14. In FIG. 1, the door 12 is mounted for opening in a left-hand opening configuration, while in FIG. 2, the door 12 is mounted for opening in a right-hand opening configuration. The door 12 has opposite first and second faces 22 and 24, respectively, an upper edge 26 and a lower edge 28 spaced longitudinally from the upper edge 26. Laterally opposite first and second side edges 30 and 32 extend longitudinally along the door 12 between the upper edge 26 and the lower edge 28. A longitudinal axis A (see FIG. 3) extends along the door 12 intermediate the side edges 30 and 32 and the door 12 includes a transverse thickness T (see FIG. 5) between the opposite faces 22 and 24. Door 12 has been prepared for the reception of latching hardware (not shown) by placing suitable bores 34 and 36 at a latch location L adjacent the first side edge 30 and spaced a predetermined distance D from the lower edge 28 of the door 12, in a well-known manner. The door frame 14 has a top 40 and laterally opposite first and second sides 42 and 44, respectively. The door frame 14 is shown installed within a suitably prepared opening 46 in a building wall 48.

Figure 3:
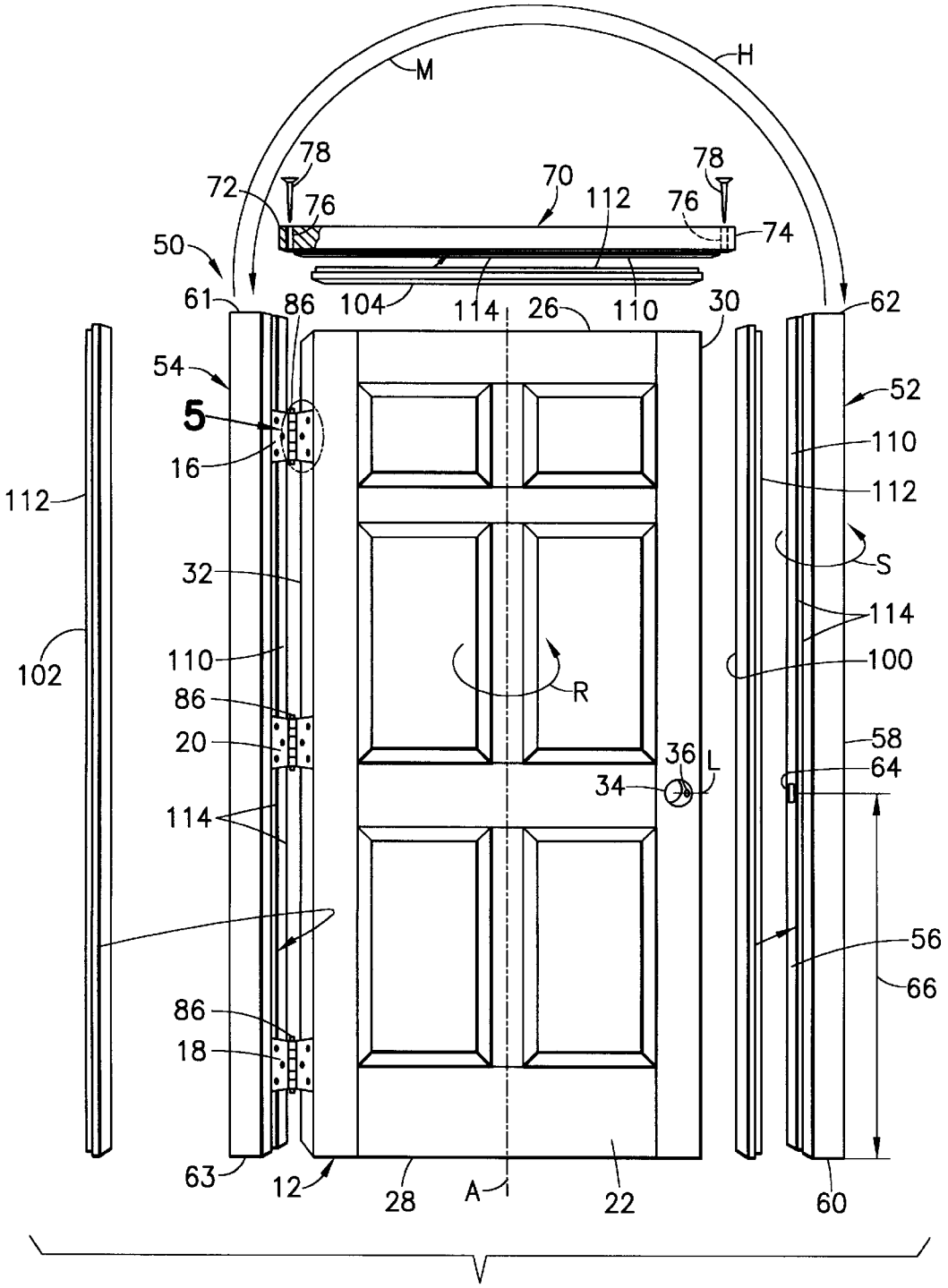
FIG. 3 is an enlarged, exploded pictorial view showing the component parts of the pre-hung door assembly kit, configured as in FIG. 1.
Figure 4:
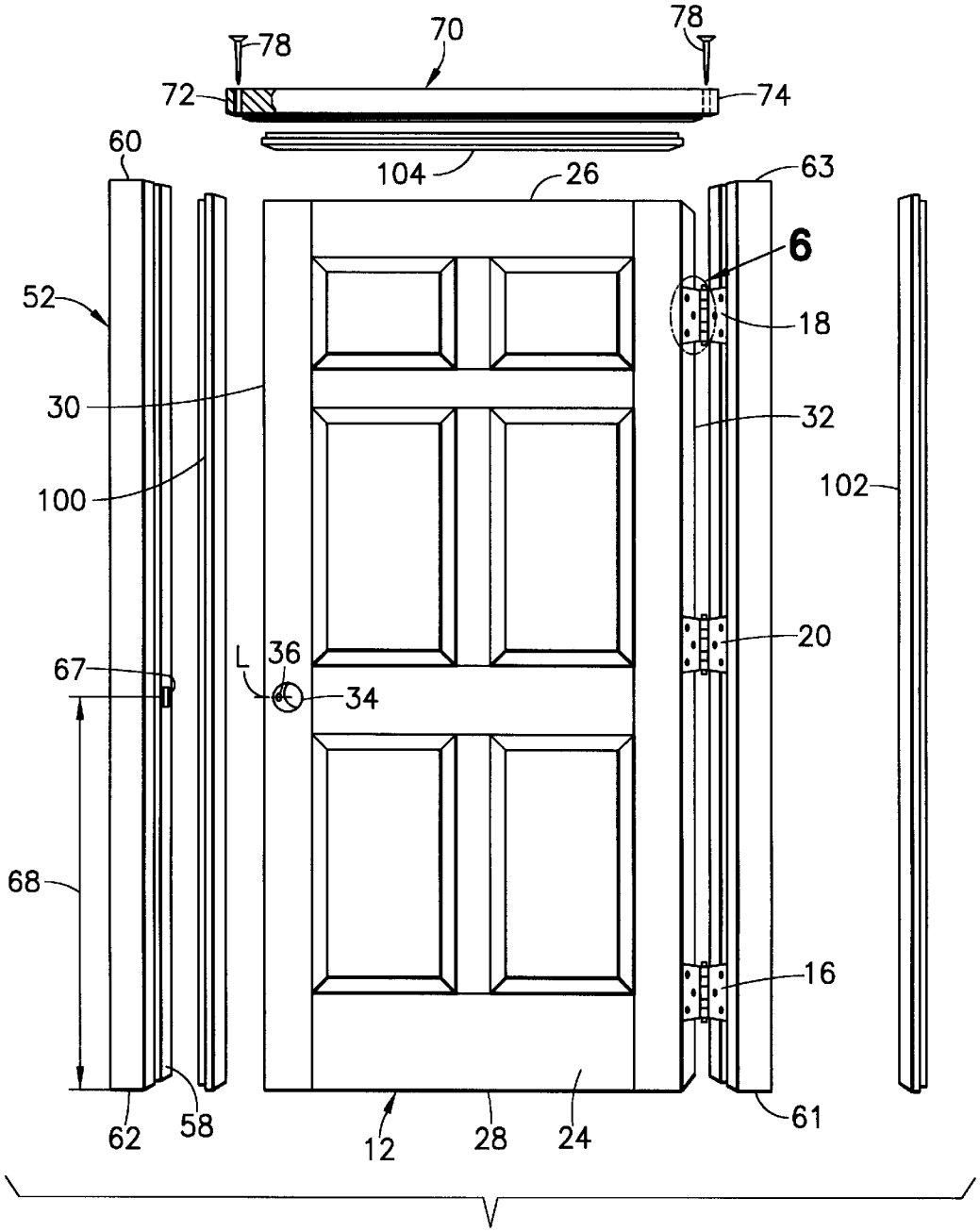
FIG. 4 is an exploded pictorial view similar to FIG. 3, but with the hand of the door reversed so as to be re-configured as in FIG. 2.

Turning now to FIGS. 3 and 4, door assembly 10 has been constructed from a pre-hung door assembly kit illustrated generally at 50. Kit 50 enables the selective reversal of the hand of the pre-hung door 12 so that an installer can choose between the left-hand opening configuration of FIGS. 1 and 3, and the right-hand opening configuration of FIGS. 2 and 4, upon installation of the pre-hung door assembly 10 in building wall 48. To that end, the door frame 14 includes a first door jamb leg 52 and a second door jamb leg 54. The first door jamb leg 52 is oriented vertically and has opposite first and second surfaces 56 and 58, respectively, a first end 60 and a longitudinally opposite second end 62. Second door jamb leg 54 also is oriented vertically and includes a first end 61 and a longitudinally opposite second end 63. In the configuration of FIGS. 1 and 3, the first surface 56 of the first door jamb leg 52 confronts the first side edge 30 of the door 12 and includes a first strike plate mortise 64 spaced from the first end 60 a distance 66 corresponding to the predetermined distance D so that a strike plate (not shown) will be located relative to the latching hardware in the door 12 for latching the door 12 in a conventional manner. A second strike plate mortise 67 is located in the second surface 58 of the door jamb leg 52 and is spaced from the second end 62 a distance 68 corresponding to the predetermined distance D, for purposes to be described below.

The door frame 14 includes a door jamb header 70 oriented horizontally and having opposite ends 72 and 74 and a selective affixation arrangement, shown in the form of pre-drilled screw holes 76 located adjacent each of the ends 72 and 74 for the reception of screws 78 which pass through the screw holes 76 and into the corresponding ends of the door jamb legs 52 and 54, in this instance the corresponding ends being end 62 of the first door jamb leg 52 and end 61 of the second door jamb leg 54. When the door jamb header 70 is affixed to the door jamb legs 52 and 54, as indicated, the door jamb header 70 extends across the top 40 of the door frame 14, spanning the distance between the door jamb legs 52 and 54 and completing the door frame 14.

The pre-hung door assembly kit 50 is delivered from the factory with the door 12 hinged to the second door jamb leg 54, and with the door jamb header 70 disconnected from the door jamb legs 52 and 54. All three of the hinges 16, 18 and 20 are mounted in the factory, door 12 itself is fully prepared in the factory with bores 34 and 36 for door latching hardware, and the strike plate mortises 64 and 67 are placed in the first door jamb leg 52 at the factory. Thus, all of the critical relationships between the door 12 and the door frame 14 are established in the factory where specialized tools and skills are available for attaining accuracy and a well finished appearance, and the necessity for such specialized tools and skills in the field is eliminated, rendering the installation of the pre-hung door assembly 10 a relatively simple matter, easily accomplished by an installer of ordinary skill. At the same time, the component parts of the pre-hung door assembly kit 50 can be arranged in a relatively compact package, having a minimal thickness essentially corresponding to the thickness T of the door 12 and, where the door jamb legs 52 and 54 and the door jamb header 70 are juxtaposed with one of the faces 22 and 24 of the door 12, laid flat over the one of the faces 22 and 24, the added thickness of those component parts.

Figure 6:
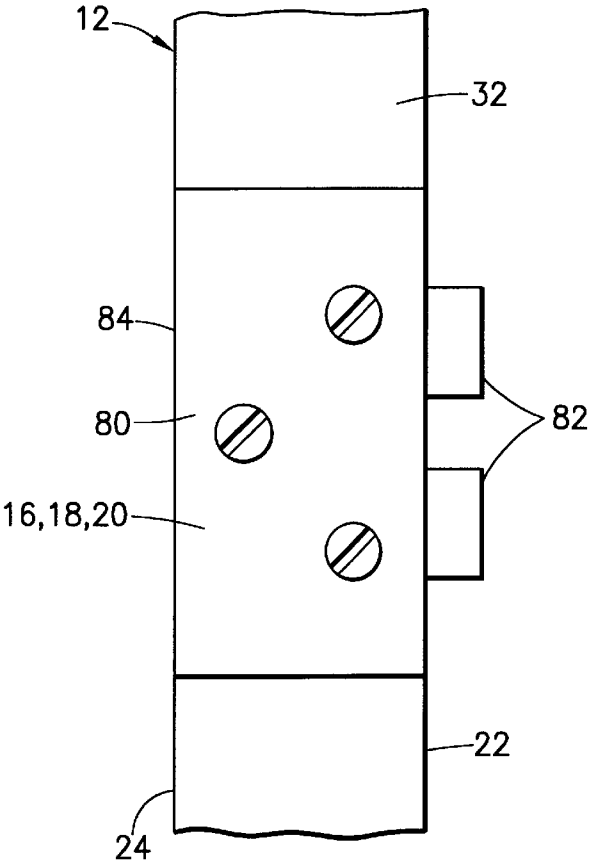
FIG. 6 is an enlarged fragmentary view similar to FIG. 5, but showing the portion designated by the circle 6 in FIG. 4.
Figure 5:
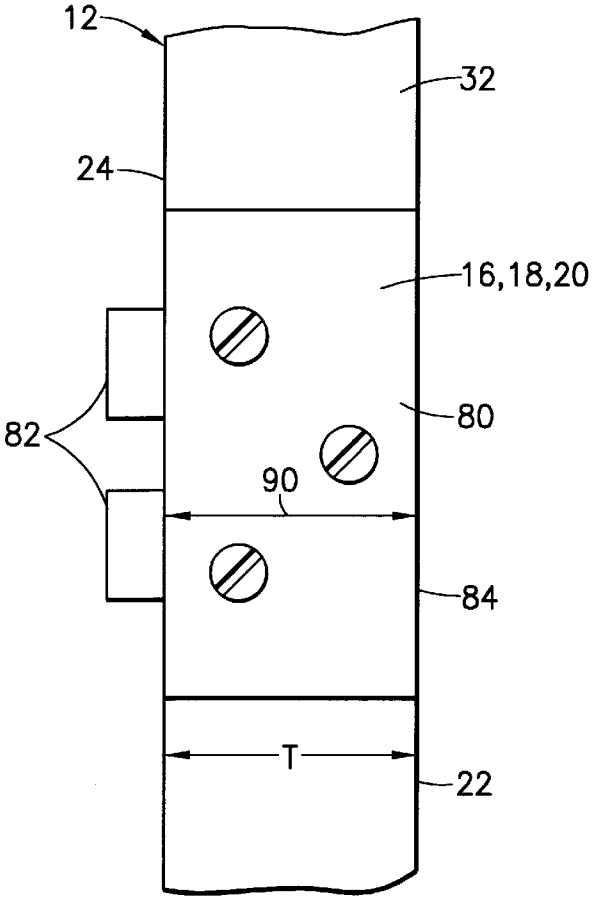
FIG. 5 is a further enlarged fragmentary view of a portion of the door designated by the circle 5 in FIG. 3.

Pre-hung door assembly kit 50 is shipped from the factory with the door 12 mounted for one particular opening, in this instance the opening being a left-hand opening, as discussed above in connection with FIGS. 1 and 3. The door assembly 10 is erected by first affixing the door jamb header 70 to the door jamb legs 52 and 54, utilizing screws 78, as indicated in FIG. 3, making sure that the first door jamb leg 52 is oriented so that the first strike plate mortise 64 confronts the latch location L of the door 12. The completed door frame 14 then is placed within a previously prepared opening in the building wall 48 in a now conventional manner and, once all of the relationships are checked for accuracy, the door jamb legs 52 and 54, and the door jamb header 70, are fastened to the wall 48 with fasteners, typically nails, which are passed through the jamb legs 52 and 54 and the jamb header 70 and into the surrounding wall structure.

Where the door 12 is to be mounted for a right-hand opening, as illustrated in FIG. 2, the component parts of the kit 50 are re-arranged so as to configure the assembly 10 as illustrated in FIG. 4, and thereby reverse the hand of the door 12 from the factory supplied left-hand opening to the desired right-hand opening. Reversal of the hand of the door 12 from the configuration shown in FIG. 3 to the configuration shown in FIG. 4 is accomplished with ease, and without the necessity for special tools and skills. Thus, referring now to FIGS. 5 and 6, as well as to FIGS. 1 through 4, each hinge 16, 18 and 20 is seen to include hinge plates 80 extending transversely from a hinge pin socket 82 to a transversely opposite hinge plate edge 84, and a hinge pin 86 (see FIG. 3) received within interdigitated hinge pin sockets 82 to join the hinge plates 80 of each hinge 16, 18 and 20 in a conventional manner. The hinge pins 86 are removed from the hinge pin sockets 82 to release the door 12 from the second door jamb leg 54, the hinge plates 80 are detached from the door side edge 32, and then the detached hinge plates 80 are inverted, from the position illustrated in FIG. 5 to the position illustrated in FIG. 6, and are re-attached to the door side edge 32 in the inverted positions. The inversion of the hinge plates 80 changes the location of the hinge pin sockets 82 from adjacent face 24 of the door 12, as seen in FIG. 5, to adjacent the face 22 of the door 12, as seen in FIG. 6. Door 12 then is rotated about the longitudinal axis A, as indicated by the arrow R in FIG. 3, to reverse the relative positions of the door side edges 30 and 32, while maintaining the longitudinal position, or height, of the latch location L. Since, in most door designs, such as the panelled design of door 12, the latch location L is not centered in the door top-to-bottom, but is located closer to the lower edge or bottom of the door than to the upper edge or top of the door, the illustrated horizontal rotation of door 12 attained by the present arrangement preserves the proper position of the latch location L, regardless of the design of the door.

Once the door 12 is rotated, the second door jamb leg 54, with hinge plates 80 still attached to the second door jamb leg 54, is moved over the door 12 through an arcuate path as illustrated by the arrow H in FIG. 3, to once again juxtapose the second door jamb leg 54 with the side edge 32 of the door 12, and to invert the jamb leg 54 so that the position of end 61 relative to end 63 in the configuration of FIG. 4 is reversed relative to the position of the ends 61 and 63 in the configuration of FIG. 3. The spacing between the hinge 16 and the adjacent end 61 of the jamb leg 54 is equal to the spacing between the hinge 18 and the adjacent end 63, and hinge 20 is located intermediate the ends 61 and 63 and equidistant from the ends 61 and 63 of the jamb leg 54 so that upon inversion of the jamb leg 54, as described, the hinge plates 80 of all of the hinges 16, 18 and 20 once again are in place for interdigitation of the respective hinge pin sockets 82 and the re-insertion of hinge pins 86 to re-mount the door 12 upon the jamb leg 54. In order to maintain a desired aesthetic appearance, it is preferred that the transverse distance 90 between the hinge pin socket 82 and the hinge plate edge 84 of each hinge plate 80 corresponds to the thickness T of the door 12 so that the hinge plate edge 84 is flush with the corresponding face 22 or 24 of the door 12 in either position of the hinge plate 80.

The first door jamb leg 52 then is moved over the door 12 through an arcuate path and is turned, as illustrated by the arrows M and S in FIG. 3, to once again juxtapose the first door jamb leg 52 with the side edge 30 of the door 12, but now with the second surface 58 of the first door jamb leg 52 confronting the side edge 30 of the door 12, and to invert the jamb leg 52 so that the position of end 60 relative to end 62 in the configuration of FIG. 4 is reversed relative to the position of the ends 60 and 62 in the configuration of FIG. 3. In this manner, the second strike plate mortise 67 confronts the latch location L, as seen in FIG. 4, and reversal of the hand of the door 12 is complete. The door frame 14, with the door 12 mounted for movement through a right-hand opening, is then fastened within the opening in the wall 48 toward completion of the installation. It is noted that while it is possible to locate the first and second strike plate mortises 64 and 67 back-to-back on the first door jamb leg 52, so that upon reversal of the hand of the door 12 all that would be necessary is movement of the door jamb leg 52 from one side 42 or 44 of the frame 14 to the other side 44 or 42, and merely turning of the door jamb leg 52 so that the appropriate surface 56 or 58 confronts the side edge 30 of the door 12, such an arrangement would tend to weaken the door jamb leg 52 by virtue of the close proximity of the first and second strike plate mortises 64 and 67 to one another. In the preferred arrangement illustrated herein, the strike plate mortises 64 and 67 are spaced longitudinally away from one another along the door jamb leg 52, thereby maintaining the integrity and strength of the door jamb leg 52, while providing appropriate factory prepared selectable strike plate mortises.

Figure 7:
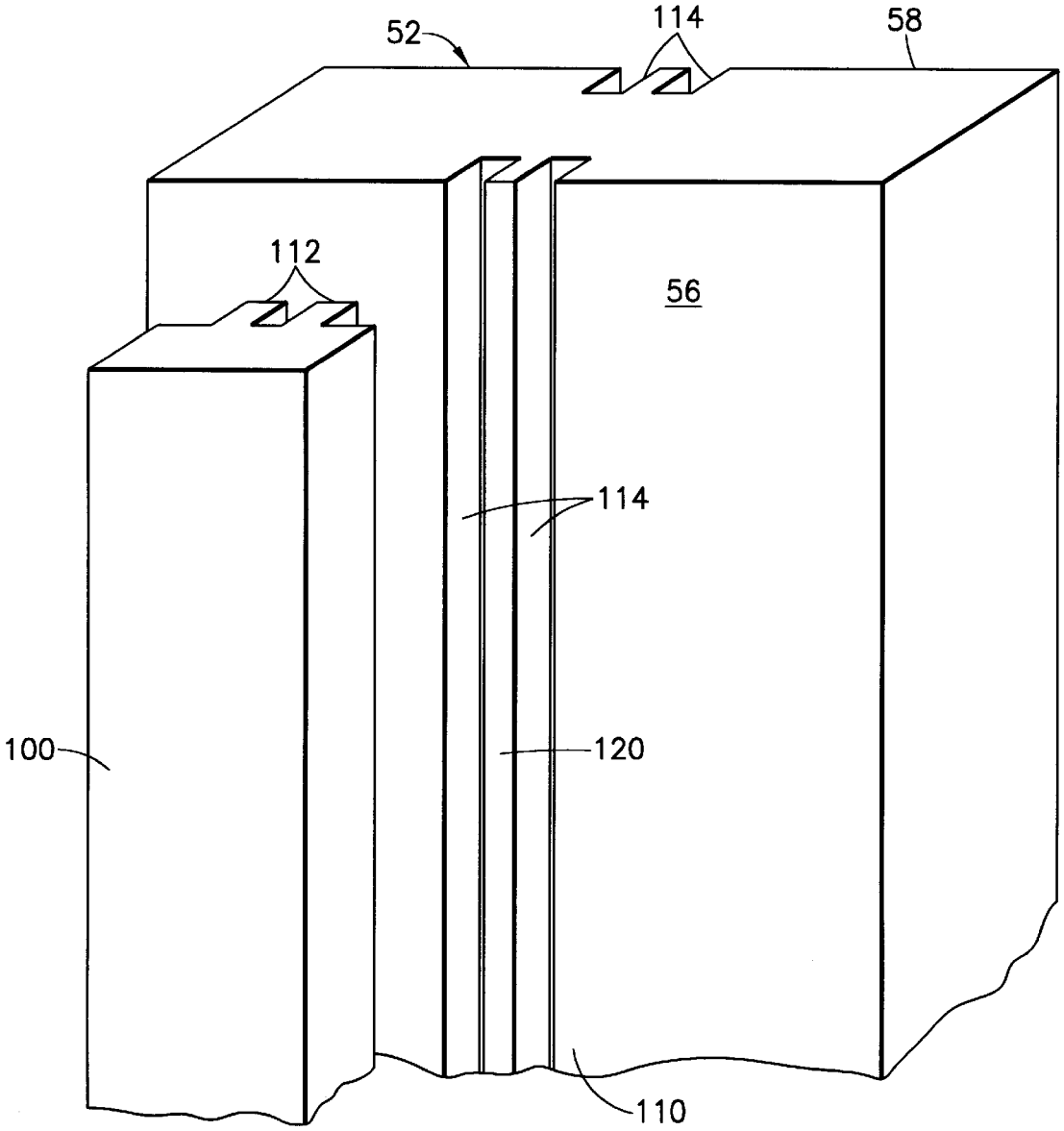
FIG. 7 is an exploded fragmentary view of component parts of the pre-hung door assembly kit.
Figure 8:
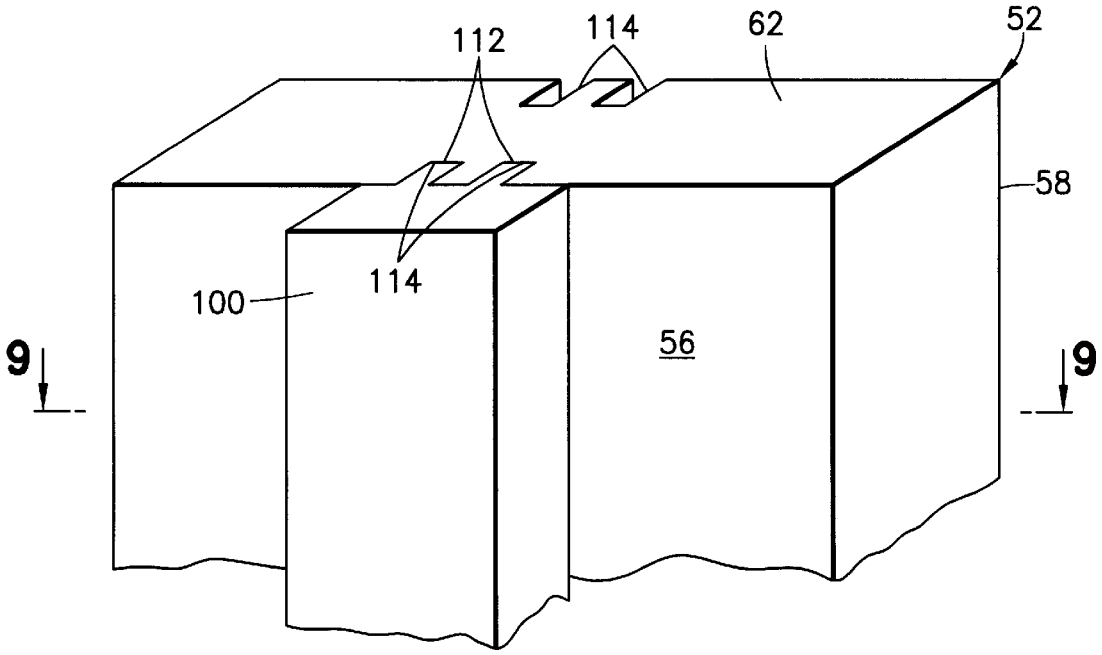
FIG. 8 is a fragmentary view similar to FIG. 7, but with the component parts assembled.
Figure 9:
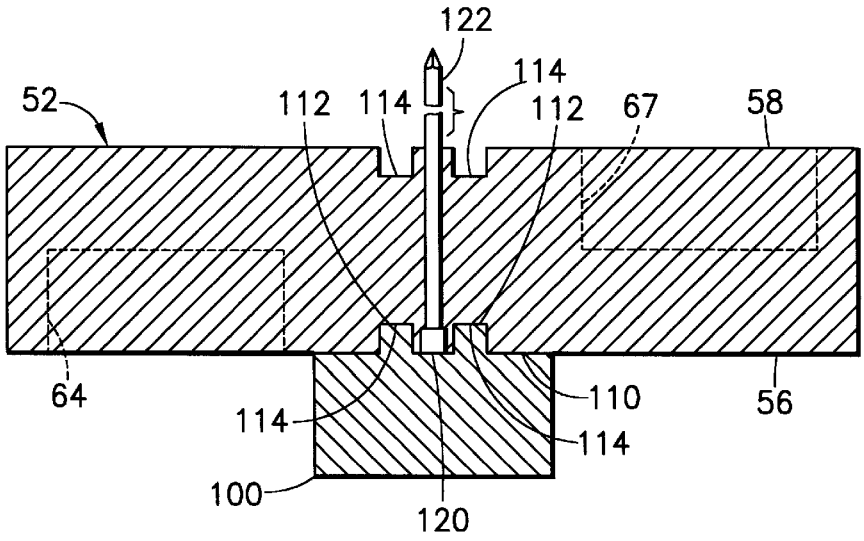
FIG. 9 is a transverse cross-sectional view taken along line 9—9 of FIG. 8.

Pre-hung door assembly kit 50 includes door stops which are shipped detached from respective door jambs. Thus, a first door stop 100 is provided for securement to the first door jamb leg 52, a second door stop 102 is provided for securement to the second door jamb leg 54, and a third door stop 104 is provided for securement to the door jamb header 70. Once the door frame 14 is fastened in place in the building wall 48, the door stops 100, 102 and 104 are placed over counterpart door stop areas 110 extending along the door jamb legs 52 and 54, and the door jamb header 70, and are secured in place to complete the installation. As best seen in FIGS. 7 through 9, door stop locating elements are illustrated in the form of ribs 112 extending longitudinally along the door stops 100, 102 and 104, and complementary grooves 114 running longitudinally along the door jamb legs 52 and 54 and the door jamb header 70. In the preferred arrangement, the ribs 112 are arranged in parallel pairs and are milled unitary with the door stops 100, 102 and 104, and the grooves 114 likewise are arranged in counterpart parallel pairs extending along corresponding door jamb legs 52 and 54, and door jamb header 70. Engagement of the ribs 112 and corresponding complementary grooves 114 positively locates the door stops 100, 102 and 104 relative to the door jamb legs 52 and 54, and the door jamb header 70, so that the precision with which the door 12 was mounted in the factory is maintained in the completed installation in the field. The first door jamb leg 52 includes grooves 114 along both surfaces 56 and 58, so that grooves 114 are made available for locating a door stop 100 when the pre-hung door assembly 10 is configured for either the left-hand or the right-hand opening. The door stops 100, 102 and 104, once located properly, are secured in place by conventional securing means, the most common expedient being an adhesive.

In order to further enhance the aesthetic appearance of the completed installation, the door jamb legs 52 and 54, and the door jamb header 70 are provided with fastener areas 120 which lie within the door stop areas 110, and preferably are located between the parallel pairs of grooves 114. By locating the fasteners (which pass through the door jamb legs 52 and 54, and through the door jamb header 70, to fasten the door frame 14 in place, as illustrated at 122 in FIG. 9) within the fastener areas 120 prior to locating and securing the door stops 100, 102 and 104 in place in the completed installation, the fastener areas 120 and, concomitantly, the fasteners 122 in the fastener areas 120, are covered by the door stops 100, 102 and 104 and are hidden from view in the completed installation, presenting a cleaner, aesthetical more pleasing appearance.

It will be seen that the present invention attains the several objects and advantages summarized above; namely: Provides a pre-hung door assembly kit in which the hand is selectively reversible with ease and accuracy; makes available the selective reversal of the hand of a pre-hung door regardless of the design of the door, while preserving the aesthetic appearance as well as the accuracy of the assembly; attains ease of reversal of a pre-hung door without the necessity for exceptional skill and specialized tools, while maintaining a high degree of precision and integrity in the completed assembly; enables the reduction of inventories at both the manufacturing facility and the sales outlets for increased efficiency and better economy; makes available a more compact pre-hung door assembly kit, requiring less storage space and less space on the selling floor; offers pre-hung door assemblies having a wider variety of door designs for greater aesthetic appeal; enables an aesthetically more pleasing appearance in the completed installation with reduced installation effort; provides rugged pre-hung door assemblies of uniform high quality for exemplary performance over a long service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a pre-hung door assembly kit which enables selective reversal of a hand of a pre-hung door mounted with hinges in a door frame for opening in one of right-hand and left-hand openings, the door having opposite first and second faces, an upper edge, a lower edge, laterally opposite first and second side edges extending longitudinally between the upper and lower edges, a longitudinal axis extending along the door intermediate the first and second side edges of the door, a transverse thickness between the opposite first and second faces, and a latch location adjacent the first side edge and spaced a predetermined distance from the lower edge, the door frame having a top and laterally opposite first and second sides, the kit comprising an improvement wherein:

the hinges each include a longitudinal hinge pin socket for location adjacent one of the first and second faces of the door, and a hinge plate extending transversely from the hinge pin socket a transverse distance to an opposite hinge plate edge;

the door frame includes first and second door jamb legs, the first door jamb leg having opposite first and second surfaces, a first end and a longitudinally opposite second end, the opposite first and second surfaces being located such that one of the first and second surfaces confronts the first side edge of the door;

the first surface of the first door jamb leg includes a first strike plate mortise spaced from one of the first and second ends a distance corresponding to the predetermined distance between the lower edge of the door and the latch location;

the second surface of the first door jamb leg includes a second strike plate mortise spaced from one of the first and second ends a distance corresponding to the predetermined distance between the lower edge of the door and the latch location; and the second door jamb leg has longitudinally opposite first and second ends and the hinges are mounted between the second door jamb leg and the second side edge of the door to hang the door in the door frame for opening in one of the right-hand and left-hand openings;

whereupon by placement of the first door jamb leg along the first side of the door frame, with the first surface confronting the first side edge of the door, the first strike plate mortise confronts the latch location, and by mounting the hinges in a first position between the second side edge of the door and the second door jamb leg, with the hinge pin sockets adjacent the first face of the door, the door is hung to open in one of the right-hand and left-hand openings; and whereupon by reversal of the hinges to mount the hinges in a second position between the second side edge of the door and the second door jamb leg, with the hinge pin sockets adjacent the second face of the door, rotation of the door about the longitudinal axis thereof, and placement of the first door jamb leg along the second side of the door frame, with the second surface of the first door jamb confronting the first side edge of the door, the second strike plate mortise confronts the latch location and the door is hung to open in the other of the right-hand and left-hand openings.

2. The invention of claim 1 wherein the first strike plate mortise is spaced from the first end of the first door jamb leg a distance corresponding to the predetermined distance between the lower edge of the door and the latch location, the second strike plate mortise is spaced from the second end of the first door jamb leg a distance corresponding to the predetermined distance between the lower edge of the door and the latch location, and the position of the first end of the first door jamb leg relative to the position of the second end of the first door jamb leg is reversed when the hand of the door is reversed.

3. The invention of claim 1 wherein the hinges include a first hinge spaced a first longitudinal distance from the first end of the second door jamb leg, a second hinge spaced a second longitudinal distance from the second end of the second door jamb leg, and the first longitudinal distance is equal to the second longitudinal distance, and the position of the first end of the second door jamb leg relative to the position of the second end of the second door jamb leg is reversed when the hand of the door is reversed.

4. The invention of claim 3 wherein the hinges include a third hinge located intermediate the first and second hinges, equidistant from the first and second ends of the second door jamb leg.

5. The invention of claim 1 wherein the hinges, when in the second position, are inverted relative to the orientation of the hinges in the first position.

6. The invention of claim 5 wherein the transverse distance between the hinge pin socket and the hinge plate edge of each of the hinges corresponds to the thickness of the door such that the hinge plate edge is flush with the other of the first and second faces of the door.

7. The invention of claim 1 including door stops, door stop areas extending along each of the first and second door jamb legs, and door stop locating elements for selectively locating the door stops on the door jamb legs along the door stop areas.

8. The invention of claim 7 wherein the door stop locating elements include grooves, and ribs complementary to the grooves.

9. The invention of claim 8 wherein the grooves extend longitudinally along the door jamb legs and the ribs are integral with the door stops.

10. The invention of claim 7 including fastener areas within the door stop areas of the door jamb legs, the fastener areas being located such that the fastener areas are covered by the door stops when the door stops are in place on the door jamb legs.

11. The invention of claim 10 wherein the door stop locating elements include grooves, and ribs complementary to the grooves.

12. The invention of claim 11 wherein the grooves extend longitudinally along the door jamb legs and the ribs are integral with the door stops.

13. The invention of claim 1 wherein the door frame includes a door jamb header having opposite ends, a selective affixation arrangement for selectively affixing the opposite ends of the door jamb header to corresponding ends of the first and second door jamb legs such that the door jamb header extends across the top of the door frame between the first and second door jamb legs.

14. The invention of claim 13 including a further door stop, a further door stop area extending along the door jamb header, and further door stop locating elements for selectively locating the further door stop on the door jamb header along the further door stop area.

15. The invention of claim 14 including a further fastener area within the further door stop area of the door jamb header, the further fastener area being located such that the further fastener area is covered by the further door stop when the further door stop is in place on the door jamb header.

* * * * *